US009943170B2

(12) United States Patent
von Raabe, IV et al.

(10) Patent No.: US 9,943,170 B2
(45) Date of Patent: Apr. 17, 2018

(54) STRUCTURAL LAMINATES AND THEIR MANUFACTURING

(71) Applicants: Philip Joseph von Raabe, IV, Olympia, WA (US); Noah Sterling Roney, Olympia, WA (US)

(72) Inventors: Philip Joseph von Raabe, IV, Olympia, WA (US); Noah Sterling Roney, Olympia, WA (US)

(73) Assignee: Philip von Raabe, Olympia, WA (US)

( * ) Notice: Subject to any disclaimer, the term of this patent is extended or adjusted under 35 U.S.C. 154(b) by 0 days.

(21) Appl. No.: 14/946,651

(22) Filed: Nov. 19, 2015

(65) Prior Publication Data

US 2016/0143441 A1 May 26, 2016

Related U.S. Application Data

(60) Provisional application No. 62/082,040, filed on Nov. 19, 2014.

(51) Int. Cl.

| | |
|---|---|
| ***A47B 13/00*** | (2006.01) |
| ***A47C 5/14*** | (2006.01) |
| ***A47B 96/20*** | (2006.01) |

(52) U.S. Cl.

CPC ..... *A47C 5/14* (2013.01); *A47B 96/205* (2013.01)

(58) Field of Classification Search

CPC .. A47B 2220/0083; B65D 2519/00034; B65D 2519/00069; B65D 2519/00104

USPC .... 108/161, 57.25, 165; 297/DIG. 1, DIG. 2

See application file for complete search history.

(56) References Cited

U.S. PATENT DOCUMENTS

| | | | | | |
|---|---|---|---|---|---|
| 1,731,131 | A | * | 10/1929 | Hall | A47B 13/086 108/161 |
| 1,942,287 | A | * | 1/1934 | Heitz | A47B 13/086 108/90 |
| 2,115,130 | A | * | 4/1938 | Shults | A47B 13/12 108/27 |
| 2,276,108 | A | * | 3/1942 | Skolnik | B44F 1/06 108/161 |
| 2,717,187 | A | * | 9/1955 | Morgan | A47B 13/086 108/27 |
| 3,150,032 | A | * | 9/1964 | Rubenstein | B29C 70/023 108/161 |
| 3,212,952 | A | * | 10/1965 | Turner | A47B 13/086 108/161 |
| 3,223,056 | A | * | 12/1965 | Wilburn | A47B 13/08 108/150 |

(Continued)

*Primary Examiner* — Jose V Chen

(74) *Attorney, Agent, or Firm* — Christensen O'Connor Johnson Kindness PLLC

(57) ABSTRACT

Products manufactured from a structural laminate generally include a first elongate portion and a second elongate portion fixedly coupled together such that the layers of the structural laminate are visible on at least one surface of the products. The second elongate portion is divided to produce a cut at an intermediate position such that at least one layer of the structural laminate is removed by the cut and an intermediate layer is exposed such that it is visible on an edge of the products. Additionally, a substrate is fixedly coupled to the elongate portions in an orthogonal orientation to layers in the structural laminate of the elongate portions. In some products, portions of the structural laminate are removed to produce voids in the surface, exposing intermediate features of the structural laminate.

16 Claims, 16 Drawing Sheets

(56) References Cited

U.S. PATENT DOCUMENTS

| | | | | | |
|---|---|---|---|---|---|
| 3,511,737 | A * | 5/1970 | Kreibich | B27D 1/04 | 108/57.34 |
| 3,649,423 | A * | 3/1972 | Wilton et al. | B44C 1/26 | 108/161 |
| 3,652,360 | A * | 3/1972 | Hartman | C08L 7/00 | 156/244.11 |
| 3,946,530 | A * | 3/1976 | O'Grady | E04C 2/12 | 108/157.16 |
| 4,388,133 | A * | 6/1983 | Hirao | B27D 1/08 | 156/242 |
| 5,225,264 | A * | 7/1993 | Kato | A47B 96/206 | 428/106 |
| 5,275,862 | A * | 1/1994 | Ramadan | A47B 13/08 | 428/113 |
| 5,277,953 | A * | 1/1994 | Tsuda | B27D 1/00 | 428/106 |
| 5,565,263 | A * | 10/1996 | Ohsumi | B27D 1/00 | 264/328.1 |
| 6,231,947 | B1 * | 5/2001 | Hill | B27D 1/00 | 156/182 |
| 2005/0005827 | A1 * | 1/2005 | Chang | A47B 13/08 | 108/161 |
| 2012/0111241 | A1 * | 5/2012 | Karp | A47B 13/08 | 108/157.17 |
| 2015/0320208 | A1 * | 11/2015 | Kanao | A47B 96/205 | 108/25 |

* cited by examiner

STRUCTURAL LAMINATES AND THEIR MANUFACTURING

CROSS-REFERENCE TO RELATED APPLICATION

This application claims the benefit of U.S. Provisional Application No. 62/082,040, filed Nov. 19, 2014, the disclosure of which is incorporated herein by reference.

TECHNICAL FIELD

The present subject matter is generally directed to products created from structural laminates, and more specifically, it relates to those products used to manufacture tables, desks, counter tops, floors, chairs, stools, cutting boards, and so on.

BACKGROUND

Woodworking specialists employ a wide variety of techniques and materials to enhance the aesthetics and value of their workpieces. The rarity of the materials used, notoriety of the woodworker, and relative amount of time necessary to create a product, among other factors, can have a large impact on the monetary value placed on the product. There is an ever-increasing demand for wood products that are both aesthetically pleasing and durable, while using materials that are lower cost and/or readily available to help reduce both price to the consumer and impact on the environment. In this regard, low-cost wood materials may be used to replace or reduce the amount of higher cost wood materials used in a product. Examples of low-cost wood materials are engineered wood products (e.g., particleboard, chipboard, medium-density fiberboard (MDF), etc.) and structural laminates (e.g., plywood), among others.

One difficulty in the use of low-cost wood materials in finished products is their relatively low aesthetic appeal when compared to higher-cost wood materials. Engineered wood products consist of small pieces of wood, often sawdust, left over from milling processes. These engineered wood products typically require a cosmetic finish (e.g., paint, veneer, linoleum, plastic, etc.) to be used as a finished product due to the irregularities and quality of the wood used. Similarly, structural laminates are often constructed from lower grade wood sections and may contain certain features that are not aesthetically pleasing in a finished product (e.g., knots, fill pieces, filler compound, etc.). With respect to structural laminates, a modification to the configuration of the laminate can lead to difficulty in meeting the durability requirements of the application in which the materials are installed.

When structural laminates are arranged in certain configurations, they can exhibit a tendency to fail under loading conditions. In some instances, the loading condition that causes a tendency to fail occurs in the most common use of the structural laminate as applied to the finished product—such as a normal force acting on a table top. Therefore, a need exists for methods that can be used to create aesthetically pleasing wood products from low-cost materials that can withstand the loading conditions present during common use of the product.

DESCRIPTION OF THE DRAWINGS

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

The following discussion provides several examples of methods for manufacturing laminated products primarily comprising wood materials, such as tables, desks, countertops, floors, chairs, stools, and cutting boards. Several embodiments of the present disclosure are directed to methods that utilize one or more portions of a structural laminate to manufacture the products. Although some embodiments of the present disclosure are described with reference to shapes suitable for the top of a table, desk, or counter, the disclosed embodiments are illustrative in nature, and therefore, should not be construed as limited to any specific application. It should therefore be apparent that the methods of the present disclosure have wide application, and are suitably used in situations where manufacturing products using a structural laminate is desirable.

Figure 29:
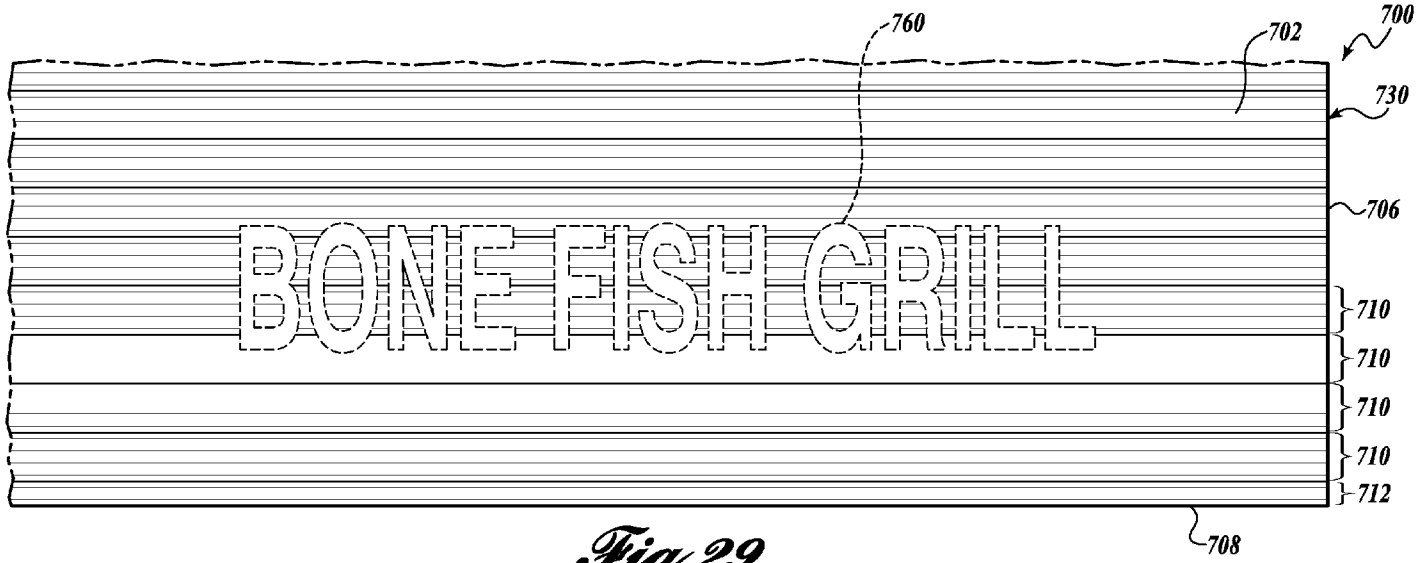
FIG. 29 is top plan view of another archetypical block, showing an insert design.
Figure 30:
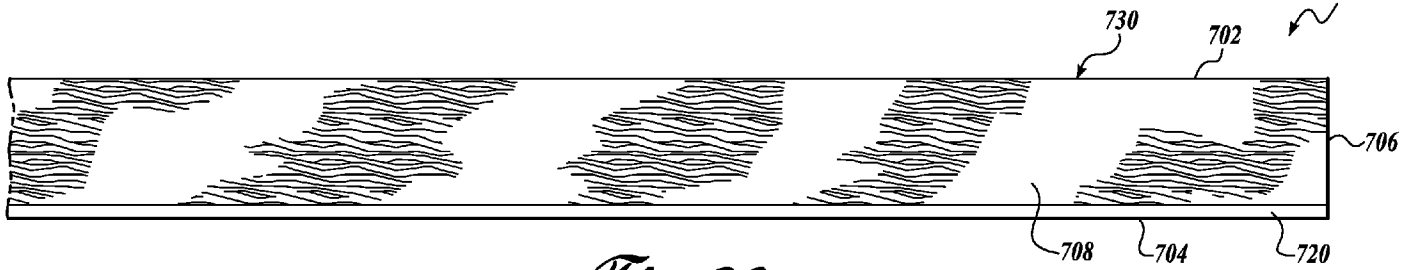
FIG. 30 is a left elevational view of the archetypical block of FIG. 29.
Figure 31:
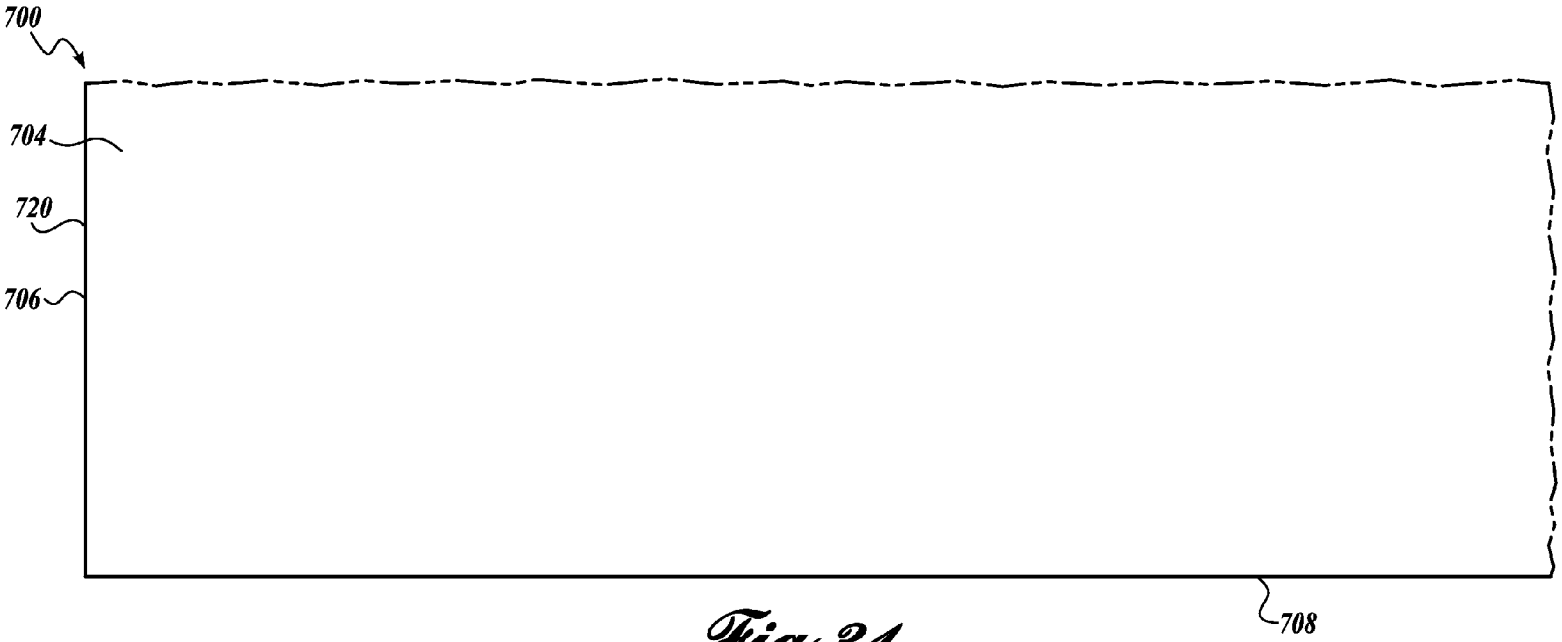
FIG. 31 is a bottom plan view of the archetypical block of FIG. 29.
Figure 32:
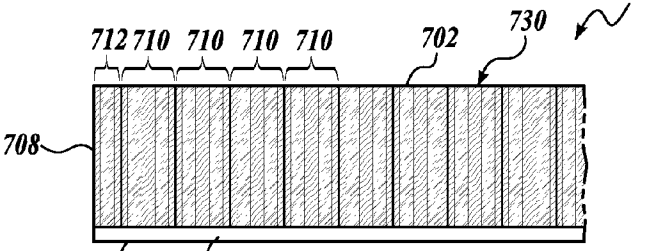
FIG. 32 is a front elevational view of the archetypical block of FIG. 29.

Although the embodiments of the present disclosure are described hereinafter with reference to the use of structural laminate material in the method of manufacture of the products, it will be appreciated that aspects of the present disclosure are suitable with other materials, such as other varieties of wood materials, engineered wood products, metal, glass, and polymers. Likewise, multiple materials are suitably used within the same product (see e.g., FIG. 29). In the present disclosure, the terms "about," "approximately," etc., mean plus or minus 5% of the stated value.

In accordance with some embodiments of the present disclosure, a table top is provided. The table top generally includes a first elongate portion of a structural laminate having a top layer, a bottom layer, an intermediate layer, and a thickness; a second elongate portion of the structural laminate having a top layer, a bottom layer, an intermediate layer, and a thickness. The bottom layer of the second elongate portion is fixedly coupled to the top layer of the first elongate portion. The second elongate portion is divided to produce a cut along a maximum dimension and parallel to the top layer of the second elongate portion at an intermediate position of the thickness of the second elongate portion such that at least the top layer of the second elongate portion is removed by the cut. The intermediate layer of the second elongate portion is visible on an edge of the table top. The table top includes a substrate fixedly coupled to the first elongate portion and to the second elongate portion. The substrate is positioned orthogonal to the layers of the first elongate portion and the second elongate portion.

In accordance with some embodiments of the present disclosure, a chair is provided. The chair generally includes a portion of a structural laminate having a top layer, a bottom layer, an intermediate layer, and a thickness. The portion of the structural laminate defines a raised portion and further defines a void in the shape of a deep trough and shallow troughs in a portion of the top layer and having a depth at least through the top layer into the intermediate layer. The chair includes a substrate fixedly coupled to the bottom layer of the portion of the structural laminate. The chair further includes at least one leg fixedly coupled to a bottom surface of the substrate away from the portion of the structural laminate.

In accordance with some embodiments of the present disclosure, a method for manufacturing a block is provided. The method for manufacturing a block generally includes obtaining a first portion and a second portion of a structural laminate. Each portion has a top layer, a bottom layer, an intermediate layer, and a thickness. The method includes the steps of abutting the bottom layer of the first portion of the structural laminate to the top layer of the second portion of the structural laminate; fixedly coupling the first portion of the structural laminate to the second portion of the structural laminate; cutting the first portion of the structural laminate at an intermediate position along the thickness of the first portion of the structural laminate such that at least one intermediate layer of the first portion of the structural laminate is revealed; and fixedly coupling a substrate having a thickness to the first portion of the structural laminate and the second portion of the structural laminate.

In accordance with any of the embodiment described herein, the table top may define an opened chamber, and wherein the substrate may be recessed in a lower surface of the opened chamber of the table top such that it is not visible in a top view or a side view of the table top.

In accordance with any of the embodiment described herein, the table top may further include an elongate member fixedly coupled to a bottom surface of the table top, wherein the elongate member may be positioned orthogonal to the table top so that the table top is substantially parallel to a floor.

In accordance with any of the embodiment described herein, the table top may further include a third elongate portion of the structural laminate having a top layer and an end, wherein the first elongate portion and the second elongate portion are fixedly coupled in a staggered orientation, wherein the top layer of the third elongate portion is fixedly coupled to the bottom layer of the second elongate portion, and wherein the end of the third elongate portion abuts an end of the first elongate portion.

In accordance with any of the embodiment described herein, the first elongate portion and the second elongate portion include wood grains, wherein the orientation of the first portion with respect to the second portion during coupling are controlled such that the wood grains form a pattern.

In accordance with any of the embodiment described herein, the pattern is one of repeating, mirrored, or herringbone.

In accordance with any of the embodiment described herein, the thickness of the substrate is between 1/16 of an inch and 1 inch.

In accordance with any of the embodiment described herein, the structural laminate is plywood.

In accordance with any of the embodiment described herein, a surface of the table top is divided to produce a cut to expose internal wood features of at least one of the first and second portions.

In accordance with any of the embodiment described herein, the portion of the structural laminate is further divided to produce a cut through a portion of the intermediate surface, thereby exposing the bottom layer.

In accordance with any of the embodiment described herein, the method for manufacturing a block may further include obtaining a third elongate portion of the structural laminate having a top layer and an end, wherein the first elongate portion and the second elongate portion are fixedly coupled in a staggered orientation; fixedly coupling the top layer of the third elongate portion to the bottom layer of the second elongate portion; and fixedly coupling the end of the third elongate portion in an abutting relationship to an end of the first elongate portion.

In one aspect of embodiments of the present disclosure, a product is manufactured using a plurality of portions of a structural laminate. The portions are generally arranged in a manner that is described in greater detail below. The arrangement of the portions includes aesthetic and durability considerations, among others. In this regard, durability of the assembled product is increased by the manufacturing methods described herein.

Figure 1:
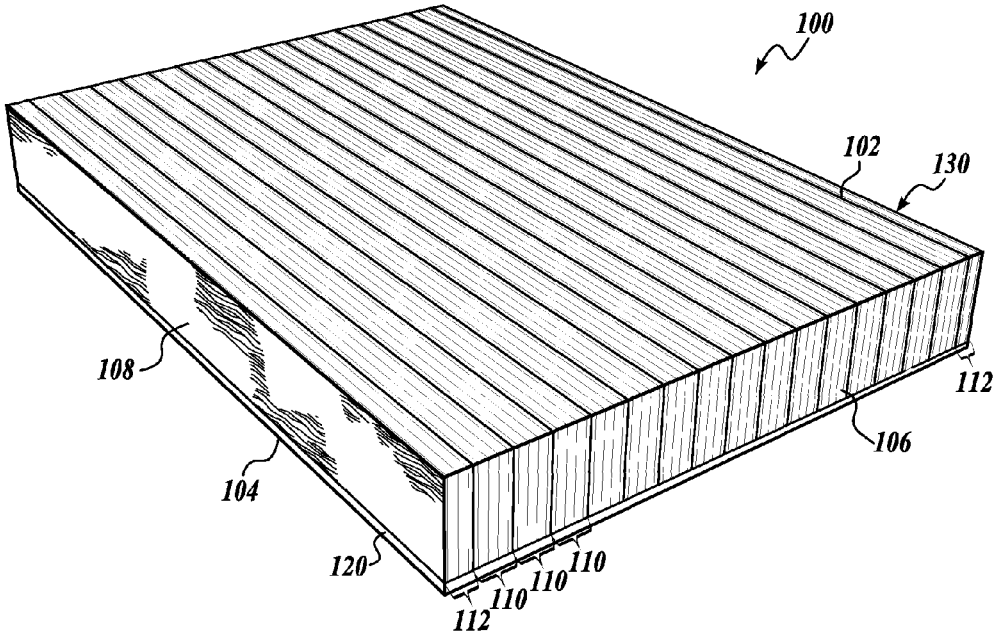
FIG. 1 is a front left top isometric view of an archetypical block.
Figure 2:
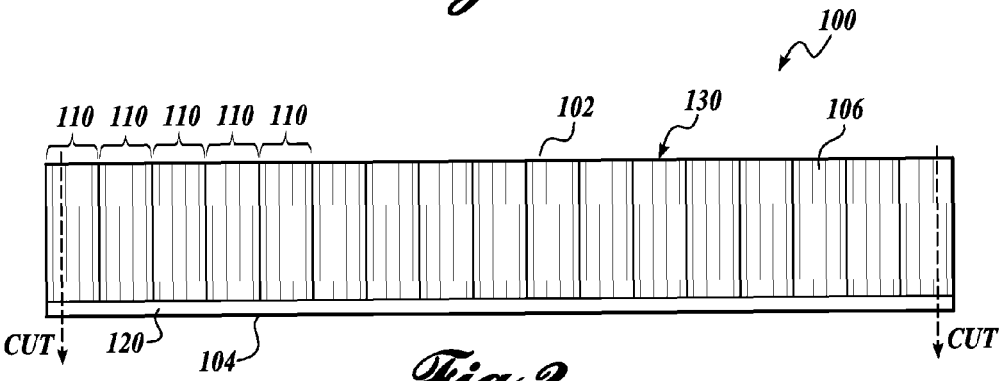
FIG. 2 is a front elevational view of the archetypical block of FIG. 1, showing general "CUT" lines applied to a strip portion.
Figure 3:
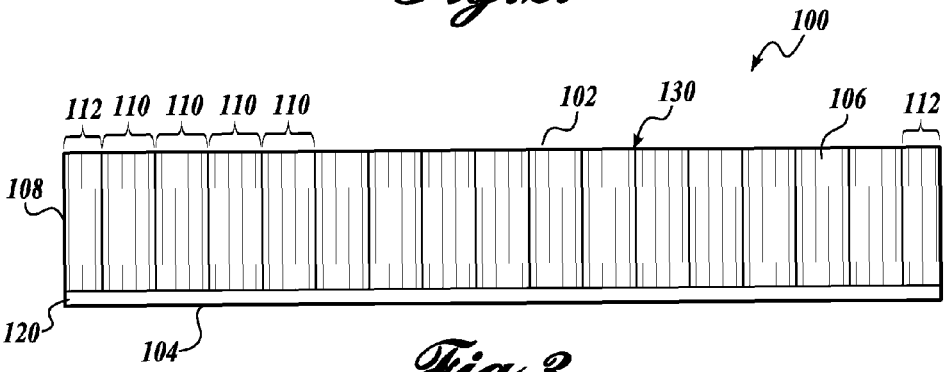
FIG. 3 is a front elevational view of the archetypical block of FIG. 1, showing the block after cutting to create a ripped portion.

Referring now to FIGS. 1-3, there is shown one embodiment of a block assembly, generally denoted 100, manufactured by the method in accordance with the aspects of the present disclosure. The block assembly 100 generally includes a strip assembly 130 and a substrate layer 120. The block assembly 100 is suitable for use as a structural member of a product. In some embodiments the block assembly 100 includes a working surface, generally shown as a top surface 102, for example if the product is a table, desk, counter top, floor, chair, stool, or cutting board. The block assembly 100 generally includes two or more strip portions 110, arranged to create the strip assembly 130. To construct the strip assembly 130, the strip portions 110 are arranged such that the top and bottom surfaces of the structural laminate are in planar communication. In the illustrated embodiment, each strip portion 110 is cut to dimensions suitable for constructing the desired size of block assembly 100.

In embodiments of the FIGS. 1-3, the strip portions 110 are depicted as a portion of plywood having multiple plies. In this regard, plywood having any number of plies and of any thickness is suitably used in the method disclosed herein. Likewise, manufacturing a product from various grades of plywood is also within the scope of this disclosure. Examples of plywood grades suitable for use with the disclosed method include plywood graded as A, A/B, A/BB, B, B/BB, BB, WG, C, BB/CC, CDX, D, X, ACX, Certified Sanded, MDO, HDO, or any combination thereof. In other embodiments, the strip portion 110 is suitably formed from any material suitable for use in the products.

In the illustrated embodiments, the structured laminate plywood is used for simplicity. In this regard, the strip portions 110 are cut from a plywood sheet in a direction perpendicular to the layers of the plywood. When the strip assembly 130 is complete, the layers of the plywood strip portions 110 are visible on at least the top surface 102 of the block assembly 100. In some embodiments, a front face 106 and a back face (not shown) of the block assembly 100 also display the layers of the strip portions 110. By contrast, a side face 108 does not display the layers of the strip portions 110. The finish of the side face 108 for the products is described in greater detail below.

The block assembly 100 is constructed by fixedly coupling at least two strip portions 110 together. In some embodiments, the strip portions 110 are fixedly coupled using a suitable adhesive. In other embodiments, the strip portions 110 are suitably fixedly coupled using other methods such as fasteners or integrated mechanical features. In the embodiments of the manufacture of the block assembly 100 from strip portions 110, examples of suitable adhesives are the various iterations of TITEBOND® wood glue manufactured by Franklin International. During assembly using the methods of the present disclosure, a mechanism for clamping the strip portions 110 during adhesive setup is suitably used. An example of a clamping mechanism (not shown) is a PLANO Vertical Glue Press manufactured by Advanced Machinery.

In embodiments of the present disclosure, any number of strip portions 110 is suitably used to construct the block assembly 100 such that the overall dimensions are suitable for the application. In this regard, the assembly of additional strip portions 110 increases the width of the strip assembly 130. Although the illustrated embodiments in FIGS. 1-3 depict generally rectangular shapes of a block assembly 100, other shapes are within the scope of the present disclosure, for example, round, polygonal, and arcuate.

During the manufacture of the strip assembly 130, surfaces are suitably cut to change the surface texture and visual pattern. In some embodiments of the present disclosure, the portion 110 used at the side face 108 of the strip assembly 130 is suitably cut at an intermediate location along the thickness of the strip portion 110. As shown most clearly in the transition from FIG. 2 to FIG. 3, the strip portion 110 nearest the side face 108 is cut in a general location near the depicted "CUT" lines to create a ripped portion 112. In the illustrated embodiment, ripping a strip portion 110 (i.e., cutting the strip portion 110 in a parallel direction to the layers of the plywood) suitably exposes a unique visual pattern as can be seen on the side face 108 of the block assembly 100 in FIG. 1.

The unique visual pattern of the side face 108 of the ripped portion 112 is a result of the arrangement of the wood and adhesive layers within the plywood. To control the variance of the visual pattern, the planar alignment of the ripped portion 112 is suitably affected by applying different pressure to the middle of the strip assembly 130 while it is located in the clamping mechanism during curing of the adhesive. As a result, in some embodiments, the cut performed on each strip portion 110 to create each ripped portion 112 suitably travels through different layers of the plywood for a unique visual pattern on the side face 108. Although cuts generally parallel to the layers of the plywood are shown in the FIGS. 1-3, in other embodiments, the strip assembly 130 is suitably cut in any direction to create a product of any desired shape.

Still referring to FIGS. 1-3, the block assembly 100 is manufactured by applying the substrate layer 120 to the strip assembly 130. The substrate layer 120 is suitably attached to the bottom of the strip assembly 130 using mechanical bonds, such as an adhesive or fasteners. The strip assembly 130, alone, has a generally reduced structural durability and strength than that of a plywood sheet as the layers of the strip assembly 130 are orthogonal to the forces applied to the top surface 102. As a result, some embodiments of the strip assembly 130, when used alone, experience warping and failure.

In order to create a more robust product capable of durability during various loading scenarios, the substrate layer 120 is suitably introduced to resist the tendency for the portions 110 to pull apart when loaded in a direction parallel to the layers of the plywood. In the illustrated embodiment of FIGS. 1-3, the substrate layer 120 is shown as fixedly attached to the bottom of the strip assembly 130 such that the bottom of the block assembly 100 is a bottom face 104. In some embodiments, the substrate layer 120 is a single layer interfacing each strip portion 110 and ripped portion 112. In other embodiments, the substrate layer 120 suitably comprises multiple layers and suitably interfaces fewer strip portions. In further embodiments, the substrate layer 120 has a thickness between about 1/16 of an inch and about 1 inch. In additional embodiments, the substrate layer 120 has a thickness between about 1/32 of an inch and about 3 inches. Still, in other embodiments, the substrate layer 120 suitably includes other systems to provide increased durability during various loading scenarios, such as a bar, strap, or dowel, which are not shown in the FIGS. 1-3.

Figure 4:
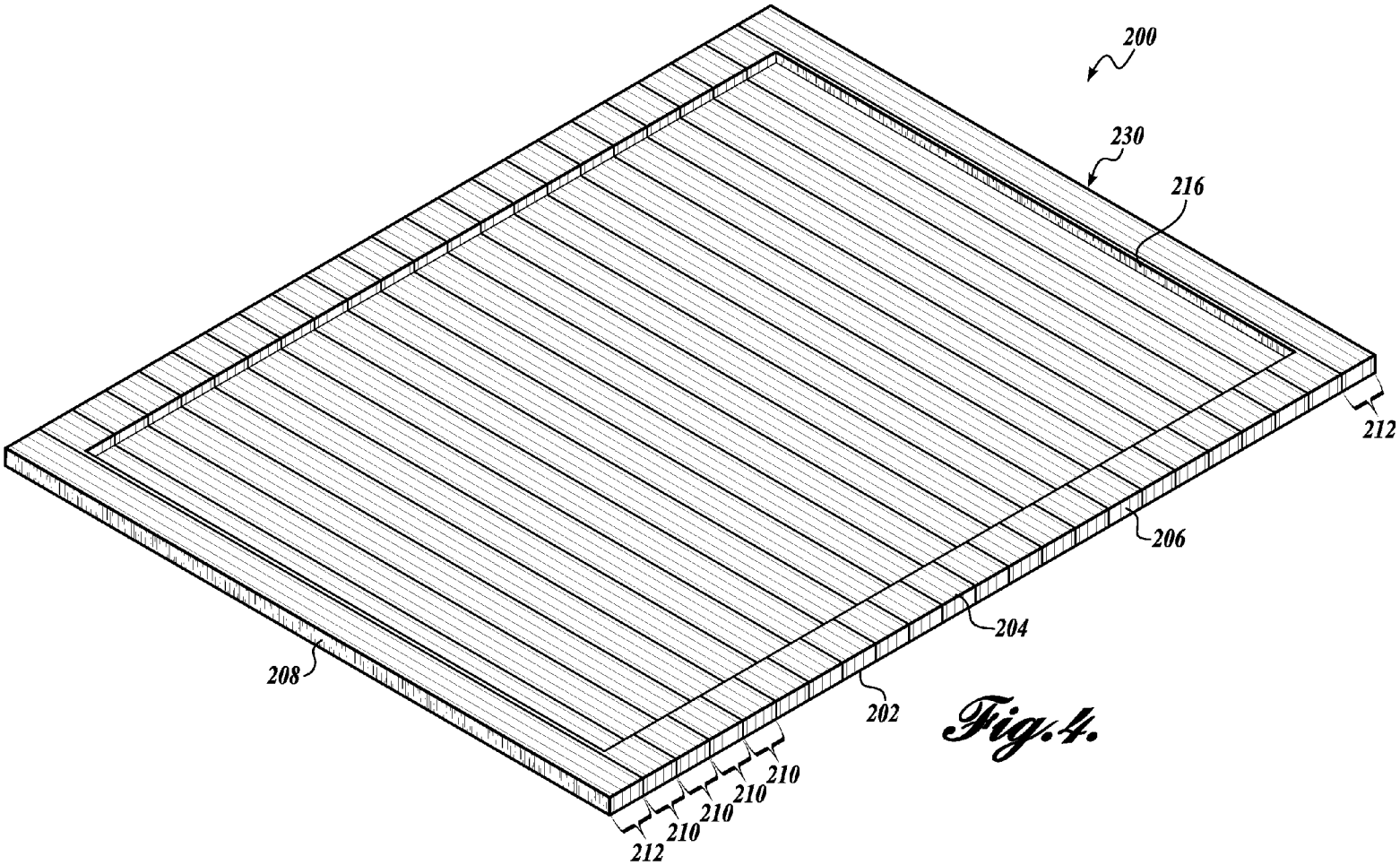
FIG. 4 is a front right bottom isometric view of another archetypical block.
Figure 5:
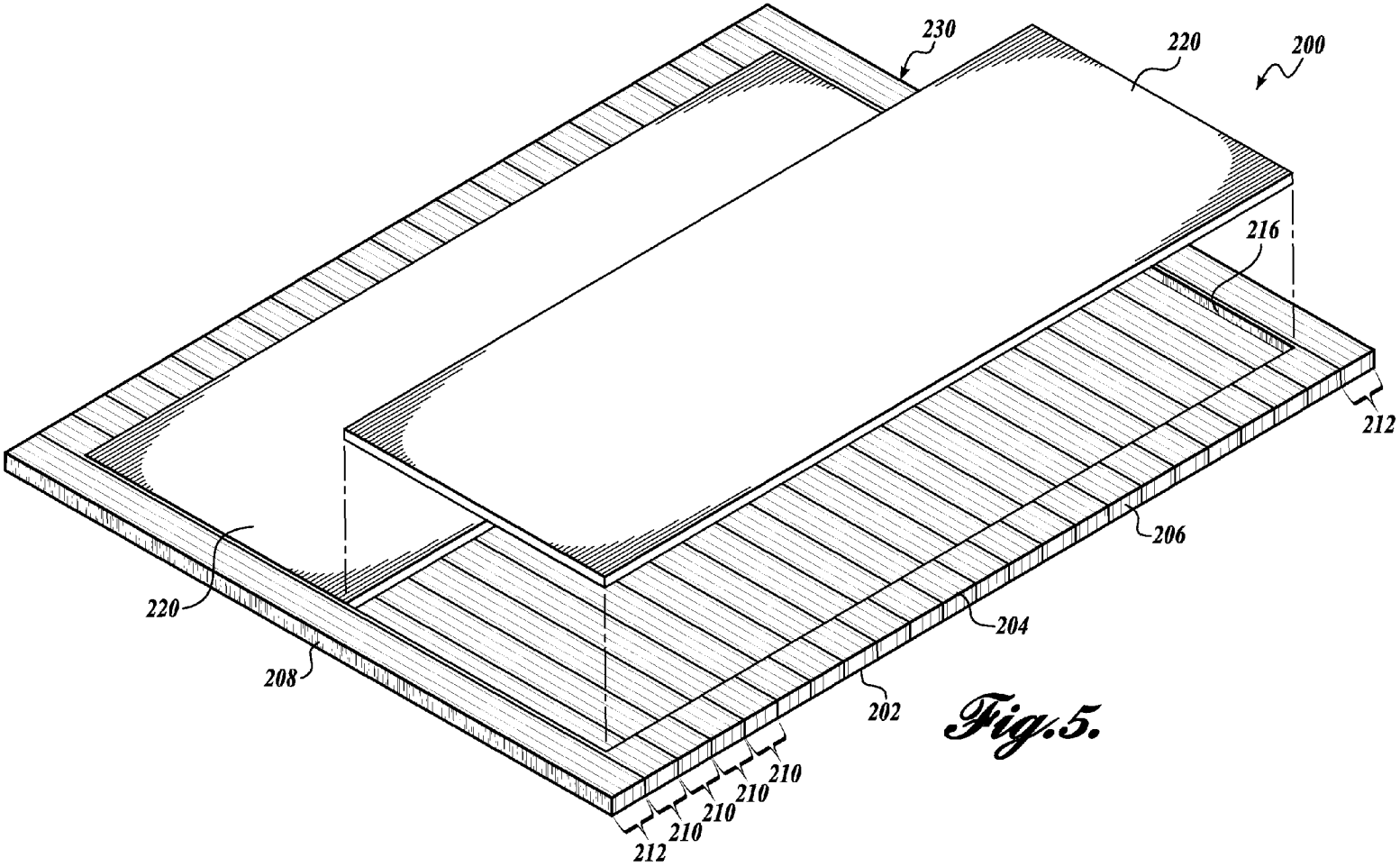
FIG. 5 is a front right bottom isometric view of the archetypical block of FIG. 4, showing the assembly of recessed substrate layers to a strip assembly.
Figure 6:
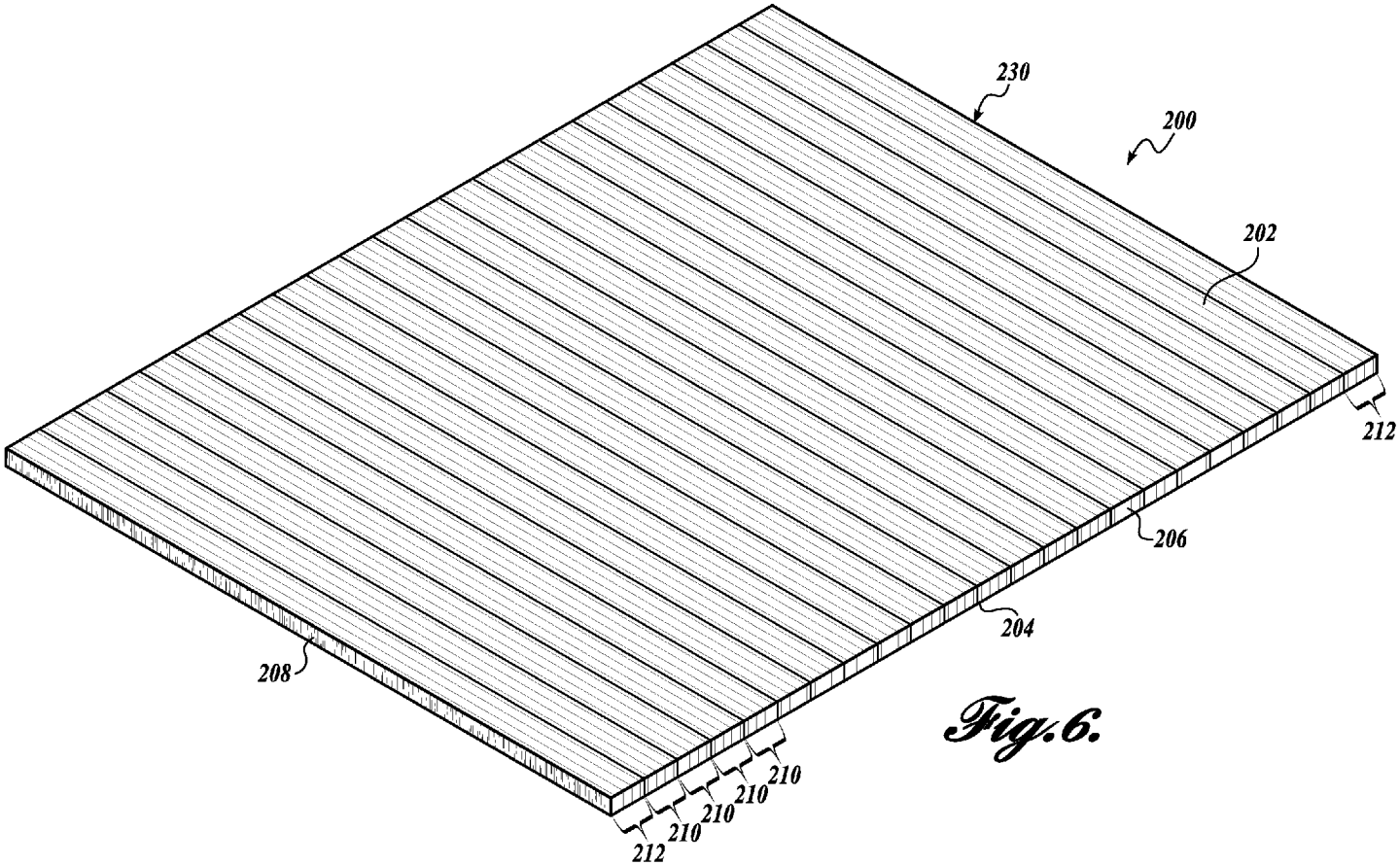
FIG. 6 is a front left top isometric view of the archetypical block of FIG. 5.

Now turning to FIGS. 4-6, an embodiment of a table top product 200 is shown. For clarity in the ensuing description, numeral references of like elements of the block assembly 100 are related, albeit different in that the nomenclatures are in the 200 series for the illustrated embodiment of FIGS. 4-6. Likewise, parts of a table generally known in the art are omitted, such as legs, drawers, and modesty panels. Nonetheless, tables manufactured using embodiments and methods described herein are suitable for use with a variety of leg, drawer, and modesty panel designs.

The table 200 is substantially similar to the block assembly 100, but is shown as constructed with more strip portions 210 than the strip portions 110 of the block assembly 100 and multiple layers of substrate 220 that are recessed into the bottom surface 204. In this regard, the table 200 generally includes a strip assembly 230 with the strip portions 210, ripped portions 212, a front face 206, a side face 208, a top surface 202, a bottom surface 204, and a recessed substrate cavity 216. Additionally, as shown in FIG. 5, the substrate includes multiple substrate layers 220 which are inserted into the recessed substrate cavity 216. In embodiments, the recessed substrate cavity 216 effectively hides the substrate from view when the table 200 is used. In this regard, the substrate layers 220 are not visible from the front face 206, the side face 208, or the top surface 202.

Figures 7, 8, 9:
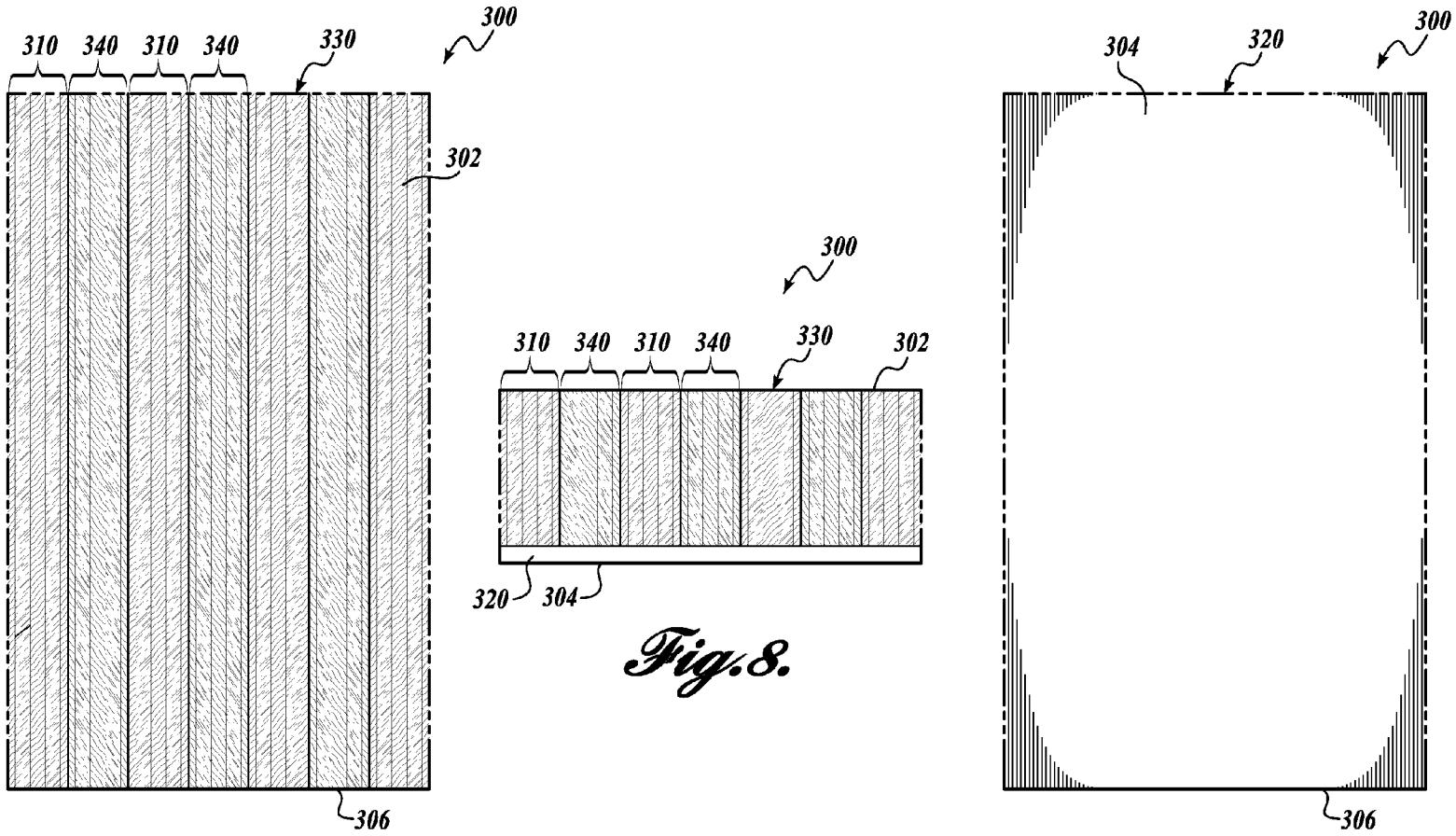
FIG. 7 is a top plan view of another archetypical block, showing a mirror repeating pattern of wood grain.
FIG. 8 is a front elevational view of the archetypical block of FIG. 7.
FIG. 9 is a bottom plan view of the archetypical block of FIG. 7.

Referring now to FIGS. 7-12, further embodiments of the present disclosure are shown. For clarity in the ensuing descriptions, numeral references of like elements of the block assembly 100 are related, albeit different in that the nomenclatures are in the 300 series for the illustrated embodiment of FIGS. 7-9 and in the 400 series for the illustrated embodiment of FIGS. 10-12. FIGS. 7-9 include a block assembly 300 and FIGS. 10-12 include a block assembly 400. In some embodiments, the strip portions are manufactured from wood. The characteristic grain of wood forms a portion of the aesthetic of the finished product. In this regard, in certain embodiments, it is desirable to control the order and orientation of assembly of the strip portions within the block assemblies 300 and 400. In this regard, matching, mirroring, sequential, or repeating patterns found in the grain of the wood can affect the appearance of the finished product.

In one embodiment of the present disclosure shown in FIGS. 7-9, the block assembly 300 includes a strip assembly 330 with a standard strip portion 310 and a reverse strip portion 340. The block assembly 300 also includes a substrate layer 320. As shown, the standard strip portion 310 and the reverse strip portion 340 are assembled in an alternating order such that the visible plies show a wood grain pattern that is mirrored and repeating. In some instances of wood grain, the pattern can be herringbone in nature, such as that shown in the combination of the standard strip portion 310 and the reverse strip portion 340 in FIG. 7. The edges of the illustrated embodiment are shown in broken line to signify that the size of the block assembly 300 is not constrained to the number of strip portions 310 and 340 shown. Likewise, the strip portions located on the edges of the strip assembly 330 may be ripped in a similar fashion as the ripped portions 112, described in reference to block assembly 100 above, to create a unique aesthetic.

Figure 12:
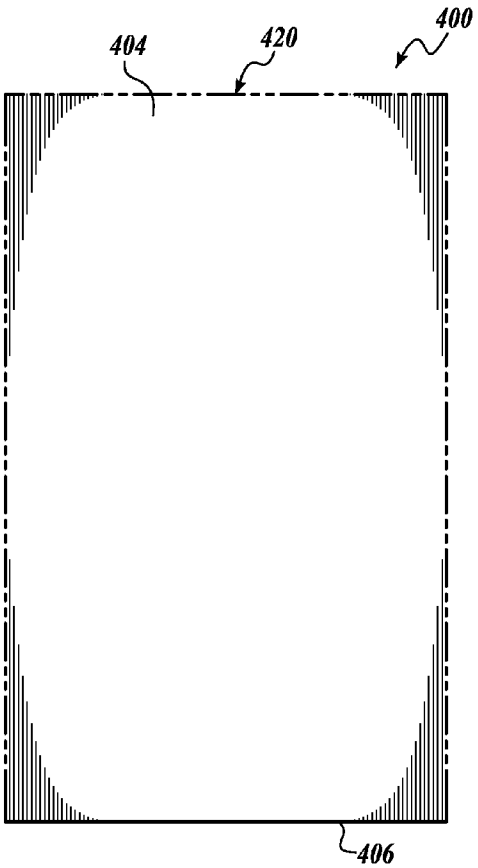
FIG. 12 is a bottom plan view of the archetypical block of FIG. 10.
Figure 11:
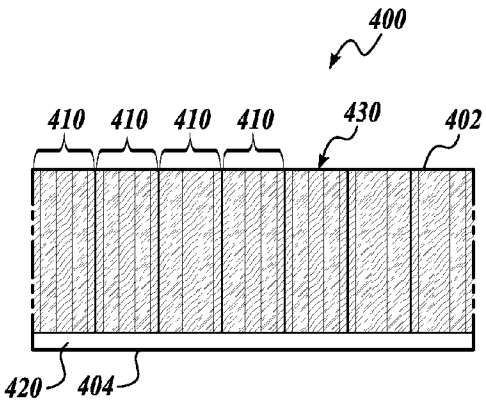
FIG. 11 is a front elevational view of the archetypical block of FIG. 10.
Figure 10:
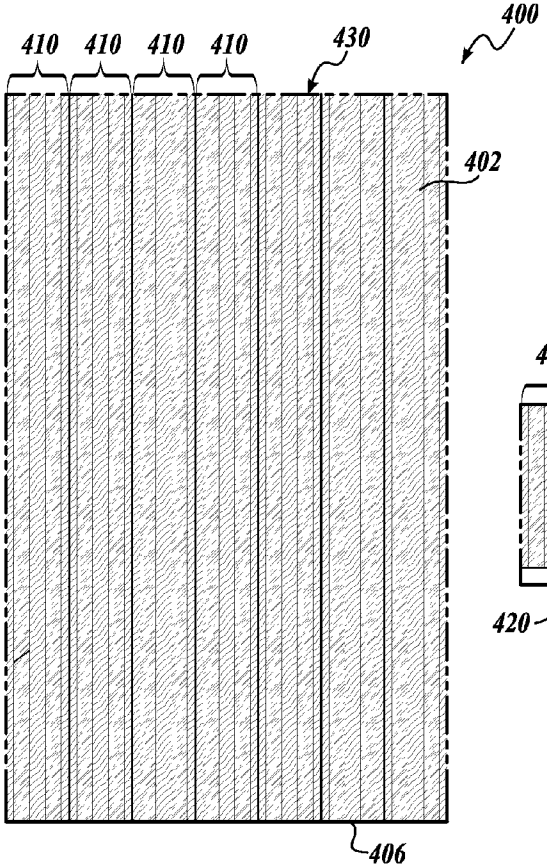
FIG. 10 is a top plan view of another archetypical block, showing a sequential repeating pattern of wood grain.
Figure 13:
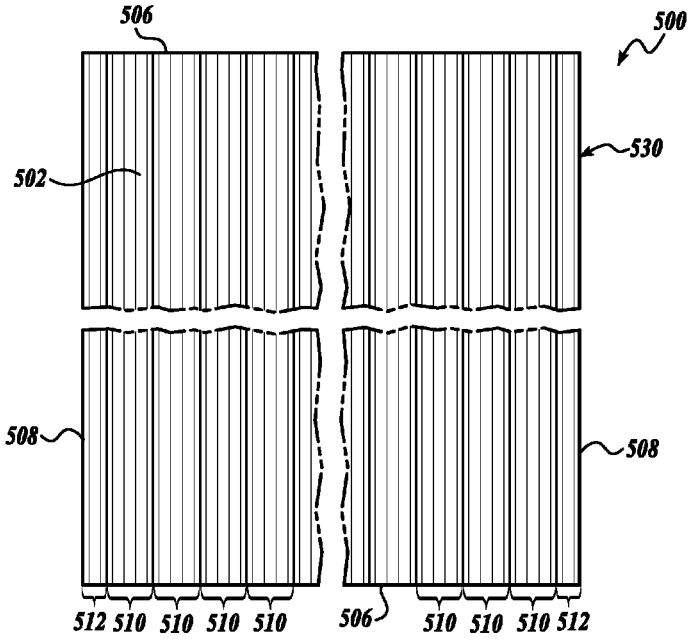
FIG. 13 is a top plan view of another archetypical block, showing a block of indeterminate length and width.
Figure 14:
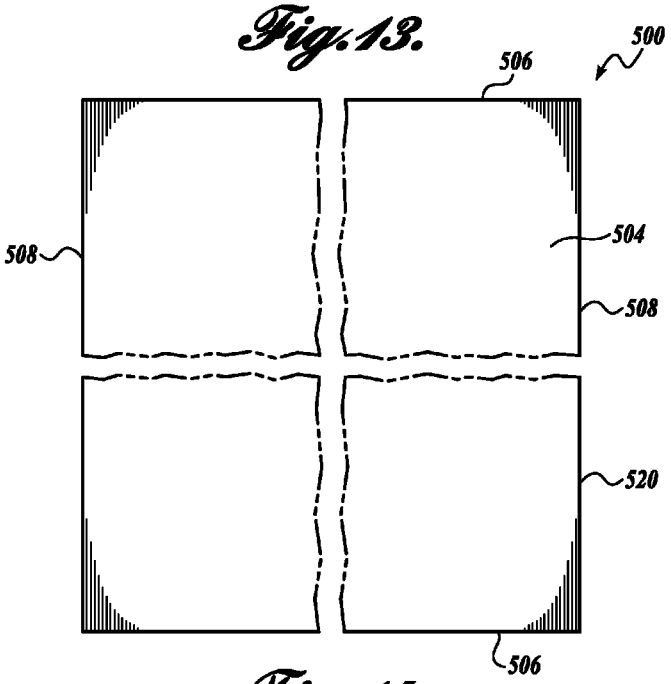
FIG. 14 is a bottom plan view of the archetypical block of FIG. 13.
Figure 15:
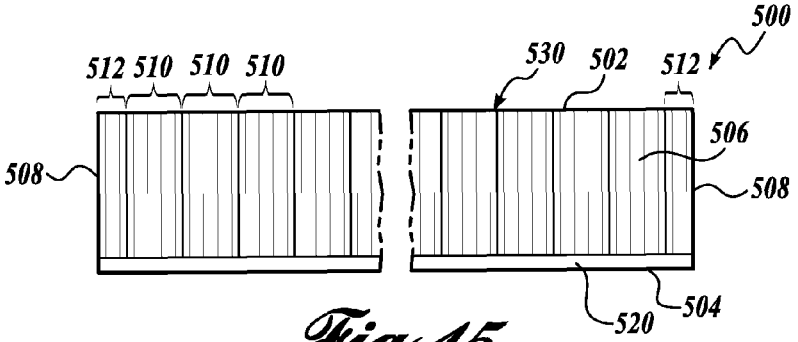
FIG. 15 is a front elevational view of the archetypical block of FIG. 13.
Figure 16:
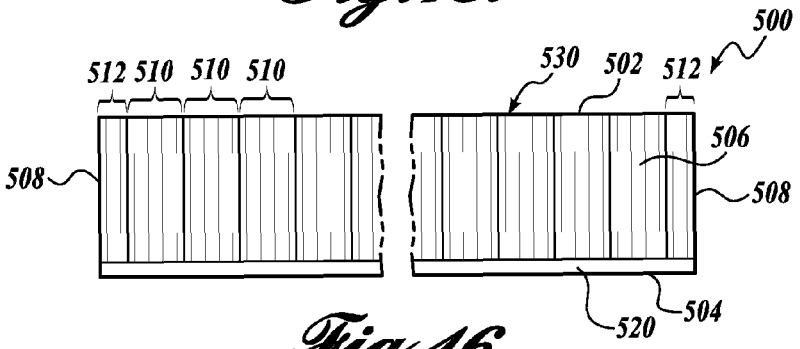
FIG. 16 is a rear elevational view of the archetypical block of FIG. 13.
Figure 17:
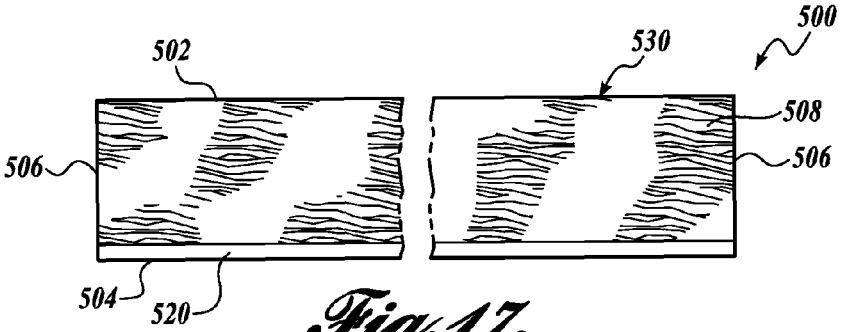
FIG. 17 is a right elevational view of the archetypical block of FIG. 13.
Figure 18:
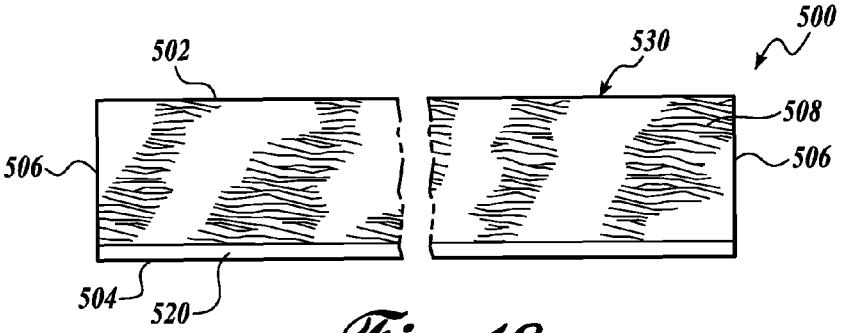
FIG. 18 is a left elevational view of the archetypical block of FIG. 13.
Figure 19:
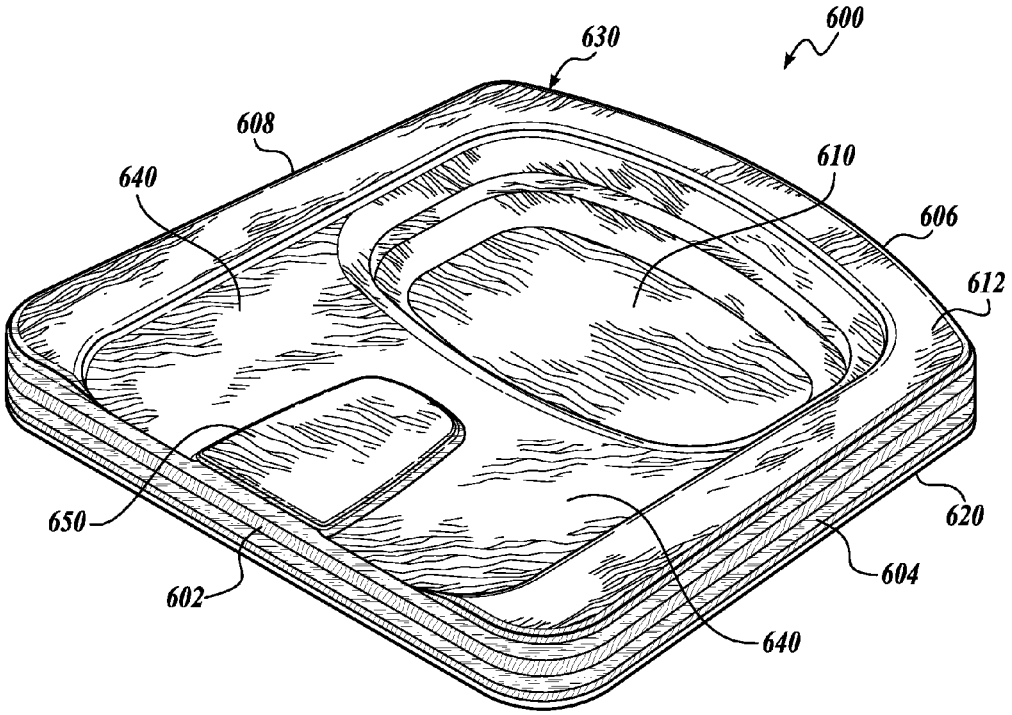
FIG. 19 is a front right top isometric view of an archetypical chair seat.

Similarly, as shown in FIGS. 10-12, the block assembly 400 includes a strip assembly 430 with a strip portion 410. The block assembly 400 also includes a substrate layer 420. As shown, the strip portions 410 are assembled, each with the same orientation, such that the visible plies show a wood grain pattern that is sequential and repeating. The edges of the illustrated embodiment are shown in broken line to signify that the size of the block assembly 400 is not constrained to the number of strip portions 410 shown. Likewise, the strip portions located on the edges of the strip assembly 430 may be ripped in a similar fashion as the ripped portions 112, described in reference to block assembly 100 above, to create a unique aesthetic. Still, in further embodiments, the strip portions of any of the embodiments herein are suitably assembled in any order.

Now referring to FIGS. 13-18, a block assembly 500 of indeterminate length and width is shown. For clarity in the ensuing description, numeral references of like elements of the block assembly 100 are related, albeit different in that the nomenclatures are in the 500 series for the illustrated embodiment. The block assembly 500 generally includes a strip assembly 530 with strip portions 510, ripped portions 512, a front face 506, a side face 508, a top surface 502, a bottom surface 504, and a substrate layer 520.

As shown, the block assembly 500 can be of any suitable length and width for creating the various products described herein. In this regard, any number of strip portions 510 and ripped portions 512 is suitably used to control the width of the block assembly 500 in the direction along the front face 506. However, the same method cannot be used to increase the length as plywood sheets are generally only available in discrete lengths, such as 8 or 10 feet. In some embodiments, the required installation of the block assembly 500 dictates a product that is longer than the length of a standard plywood sheet in the direction along the side face 508. To achieve the longer block assembly 500, the strip portions 510 are staggered during assembly (see, for example, FIG. 33 explained in further detail below) such that the ends of adjacent strip portions 510 do not align. The offset distance is any suitable distance to meet the design characteristics required for the product, namely durability and aesthetic considerations.

In embodiments of the present disclosure, if one or more of the strip portions or ripped portions are manufactured from wood, it is desirable to control environmental conditions, such as temperature and relative humidity, during the manufacturing process of the products. Considerations for temperature and humidity control are dependent on factors of the manufacturing process, including material, adhesive type, size, density, and targeted tolerances. In one embodiment, temperature is controlled to a range of about 68° F. to about 72° F. In another embodiment, temperature is controlled to a range of about 60° F. to about 80° F. In a further embodiment, relative humidity is controlled to a range of about 40% to about 60%. In an additional embodiment, relative humidity is controlled to a range of about 30% to about 70%.

When a product manufactured from the methods of the present disclosure, such as block assembly 100, is at least partially assembled, it is suitable to shape at least one surface. Methods used in shaping a surface include planing, routing, carving, ripping, fluting, and bending. As a result of these methods, a surface, such as the top surface 102, is suitably shaped such that it is flat, which is beneficial if the product is used as a table top, desk top, countertop, floor, or cutting block. In other embodiments, when using a nonhomogeneous material, such as plywood, routing of the surface is suitably used to selectively expose different layers of the material (see FIGS. 19-28). In this regard, the shaping of the surface exposes a unique visual pattern to create the desired aesthetic of the product.

When assembled using these methods, the visible surfaces of the products are generally porous. In this regard, it is often desirable to fill surface voids with a filling agent (not pictured) to create a smoother and more consistent surface texture. One example of a filling agent is No Shrink PATCH-QUICK™ manufactured by WOODWISE®, which is suitable to fill the voids of the material. The filling agent is suitably chosen to maximize durability when the surface is subjected to moisture, impact, scuffing, and rubbing, which are common accelerated wear conditions for a table, desk, or countertop.

To prevent warping or swelling of the products, a filling agent can be applied to all external surfaces, including, for example, the top surface 102 and the bottom surface 104 of the block assembly 100. In this instance, the filling agent would be allowed to cure before coupling the substrate layer 120 to the strip assembly 130. Additionally, it is desirable to add one or more braces (not shown) to help maintain the shape of the block assembly 100 during the filling agent curing process. Once the filling agent has cured, the risk of warping and swelling is reduced and the substrate layer 120 is suitably attached.

As a finishing step for a product created from the disclosed methods using a wood material, a finish is suitably applied to one or more surfaces. The finish suitably consists of various dye and sealant layers. Examples of dyes include TRANSTINT® dyes and various brands of teak oil. An example of a sealant includes polyurethane. The sealant is suitably buffed or finished to provide a desired surface texture and appearance.

Figure 20:
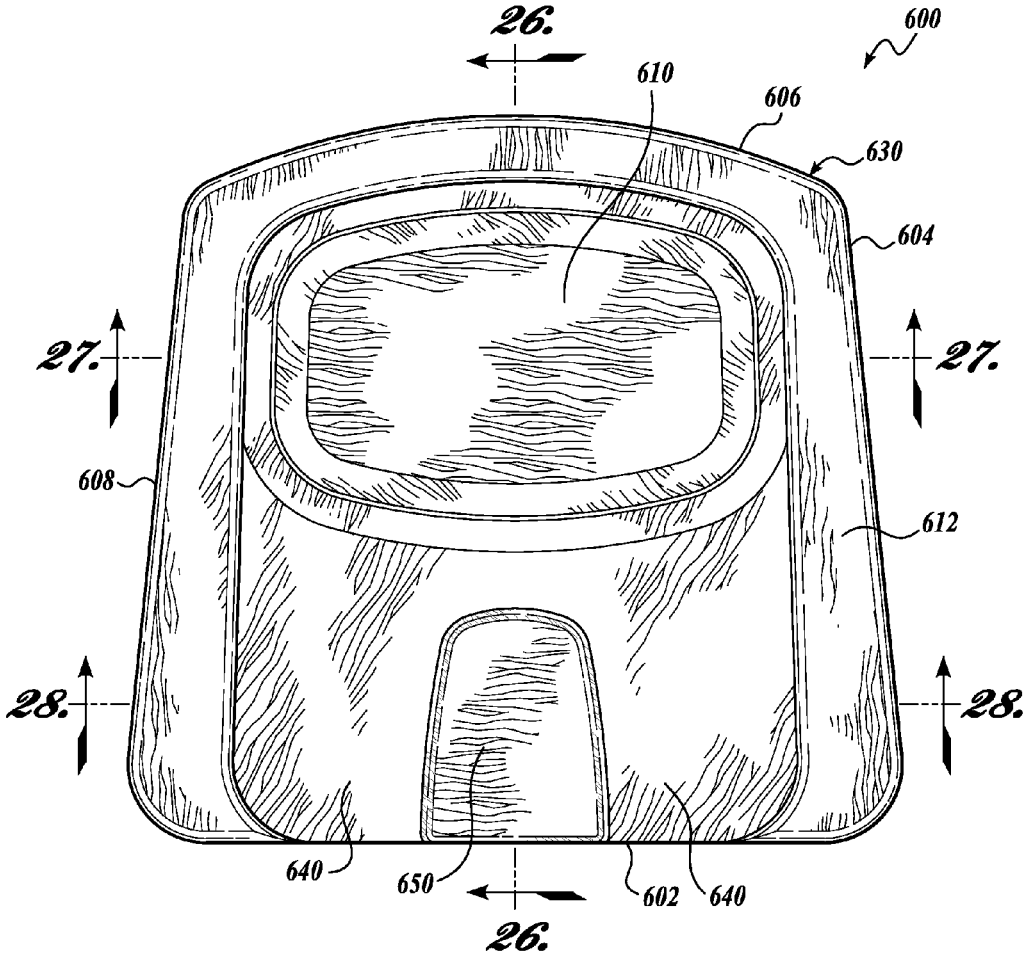
FIG. 20 is a top plan view of the archetypical chair seat of FIG. 19.
Figure 21:
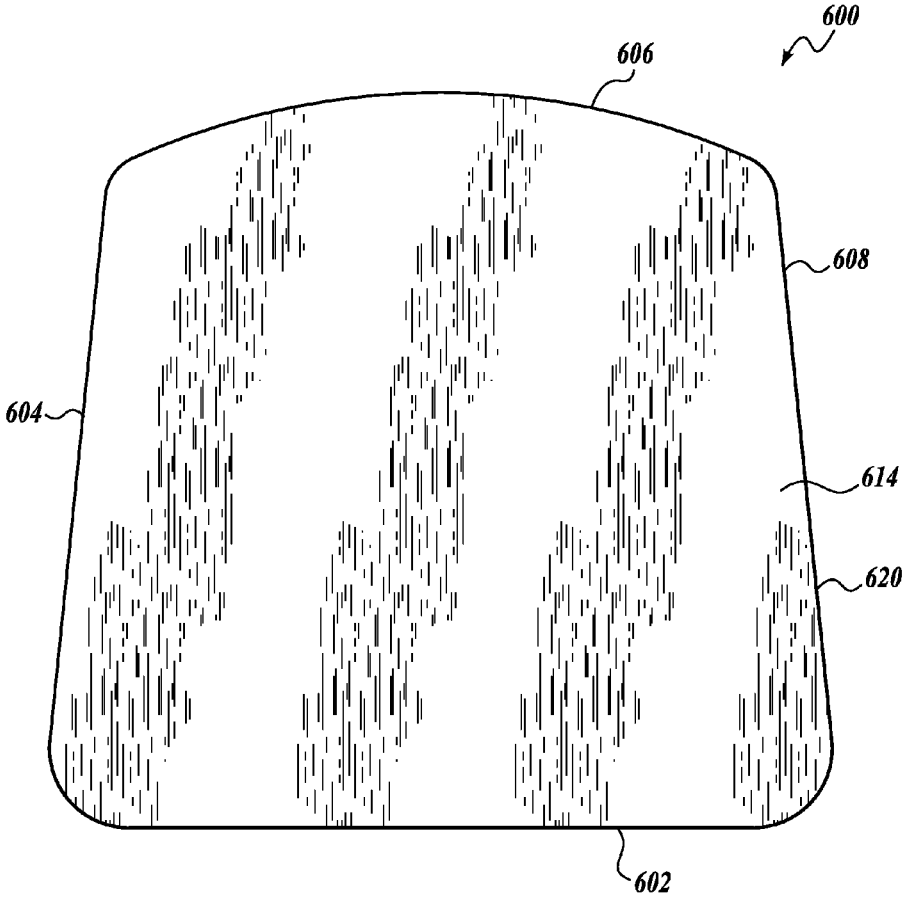
FIG. 21 is a bottom plan view of the archetypical chair seat of FIG. 19.
Figure 22:
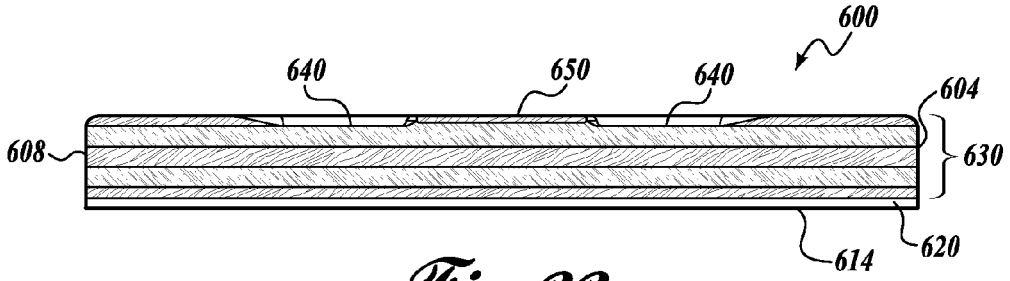
FIG. 22 is a front elevational view of the archetypical chair seat of FIG. 19.
Figure 23:
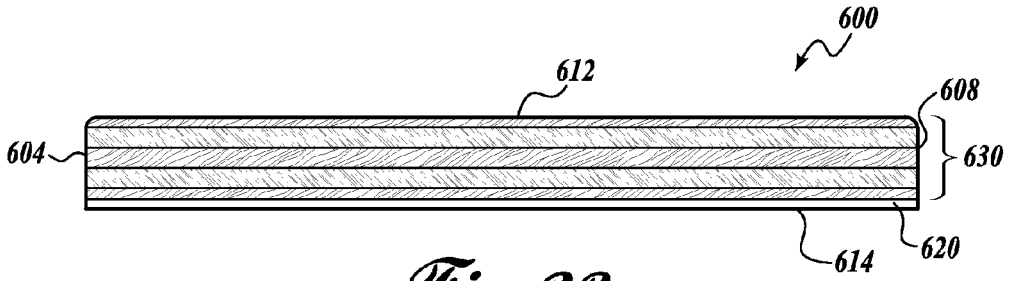
FIG. 23 is a rear elevational view of the archetypical chair seat of FIG. 19.
Figure 24:
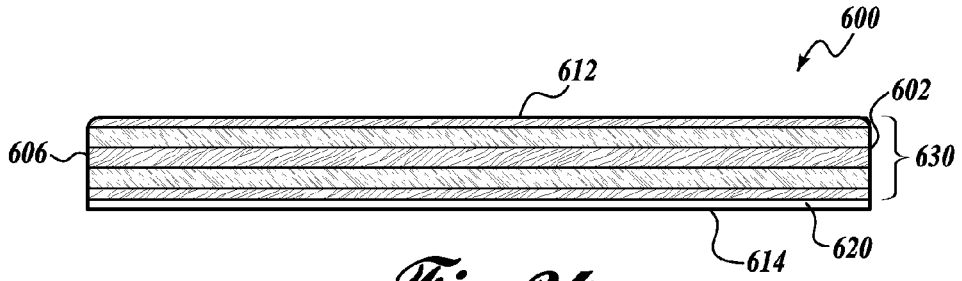
FIG. 24 is a right elevational view of the archetypical chair seat of FIG. 19.
Figure 25:
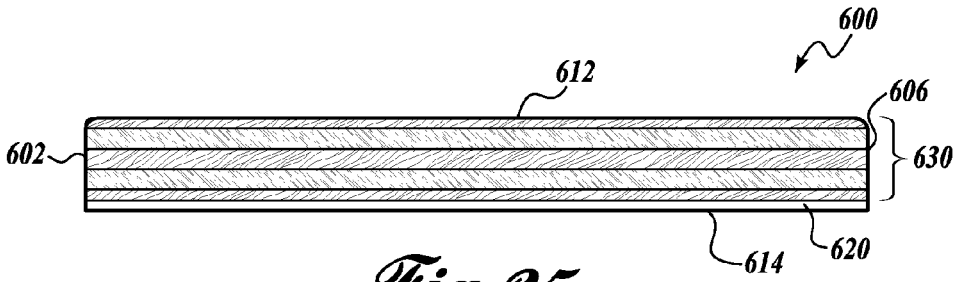
FIG. 25 is a left elevational view of the archetypical chair seat of FIG. 19.
Figure 26:
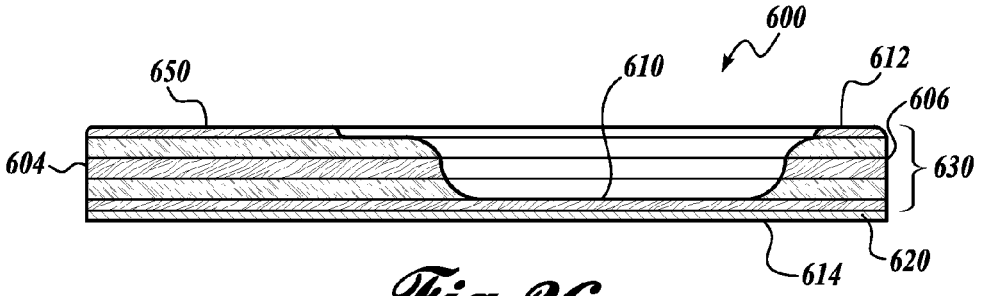
FIG. 26 is a right cross-sectional view of the archetypical chair seat of FIG. 19, shown from the location depicted in FIG. 20.
Figure 27:
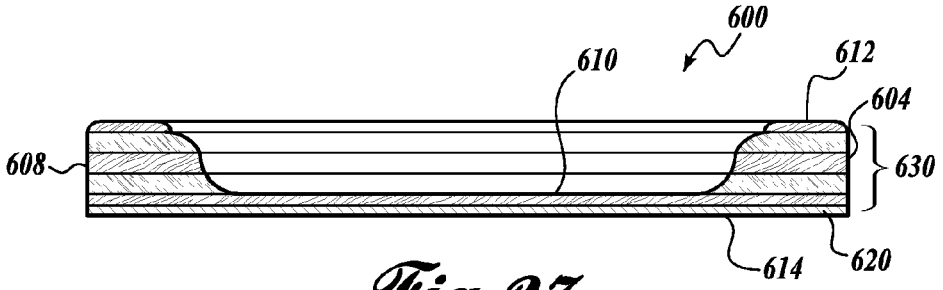
FIG. 27 is a front cross-sectional view of the archetypical chair seat of FIG. 19, shown from the location depicted in FIG. 20.
Figure 28:
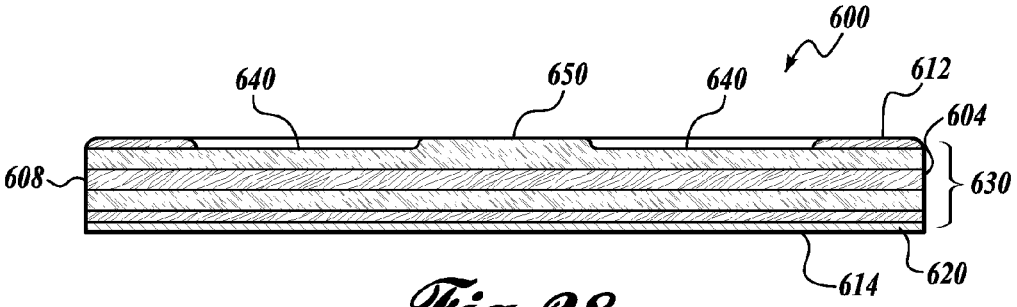
FIG. 28 is a front cross-sectional view of the archetypical chair seat of FIG. 19, shown from the location depicted in FIG. 20.

Turning now to FIGS. 19-28, an embodiment of a chair seat 600 is shown in accordance with another aspect of the present disclosure. The chair seat 600 generally includes a seat portion 630, a front face 602, a right face 604, a rear face 606, a left face 608, a top surface 612, a bottom surface 614, a substrate layer 620, a deep trough 610, a shallow trough 640, and a raised portion 650. As described above, the seat portion 630 is manufactured from plywood. In this regard a sheet of plywood is trimmed to the general shape of the perimeter as shown in FIG. 20. To create the shapes of the deep trough 610 and the shallow troughs 640, a router is suitably used. The layers of the plywood are exposed using this method to create a unique aesthetic while shaping the seat portion 630 for more comfort to the user of the chair (full assembly not shown). In the illustrated embodiment, the deep trough 610 generally aligns with the lower pelvic bone and gluteus maximus areas of the user. Likewise, the two shallow troughs 640 generally align with the femur bones and the upper thigh areas of the user. The contours of the routed areas, including the deep trough 610 and shallow troughs 640 are shown in greater detail in the cross sections of the chair seat 600 as noted and shown in FIGS. 26-28. Although the illustrated embodiment is an ornamental design of a chair seat 600, other designs and products manufactured using this method are within the scope of the present disclosure.

The routing of certain areas of the plywood, especially of greater depth as with the deep trough 610, can create a general weakness in the chair seat 600 due to lack of material remaining. In the illustrated embodiment, using plywood having 5 layers, the deep trough 610 removes 4 of the 5 layers of the plywood. In this regard, the area of the deep trough 610 would have less resistance to cracking and breaking during use. As a remedy, in some embodiments, a substrate layer 620 is used to reinforce and strengthen the seat portion 630. As with other embodiments described herein, the substrate layer 620 is suitably bonded or mechanically attached to the seat portion 630. As shown in the FIGURES, sharp edges are also suitably rounded to a fillet shape to increase comfort to the user and create a finished aesthetic of the product.

Turning now to FIGS. 29-32, another embodiment of a table or countertop is shown using the methods of the present disclosure. For clarity in the ensuing description, numeral references of like elements of the block assembly 100 are related, albeit different in that the nomenclatures are in the 700 series for the illustrated embodiment. The block assembly 700 generally includes a strip assembly 730 with strip portions 710, ripped portions 712, a front face 706, a side face 708, a top surface 702, a bottom surface 704, and a substrate layer 720. The block assembly 700 is similar to the block assembly 100, except that the block assembly 700 includes one illustrative example of an inserted design 760 that is optionally added in some embodiments. As shown the letters "BIG FISH GRILL" are optionally added to the block assembly 700 to create a custom aesthetic to the finished product. In some embodiments, the inserted design 760 is formed from metal to contrast the wood material of the strip assembly 730. In other embodiments, the inserted design 760 is formed from any suitable material, including plastic, glass, wood, metal, concrete, stone, etc. Likewise, the letters shown in the illustrated embodiment are only an example of the inserted design 760. In other embodiments, any suitable inserted design 760 is used, including letters, numbers, artistic designs, logos, trademarks, etc.

Figure 33:
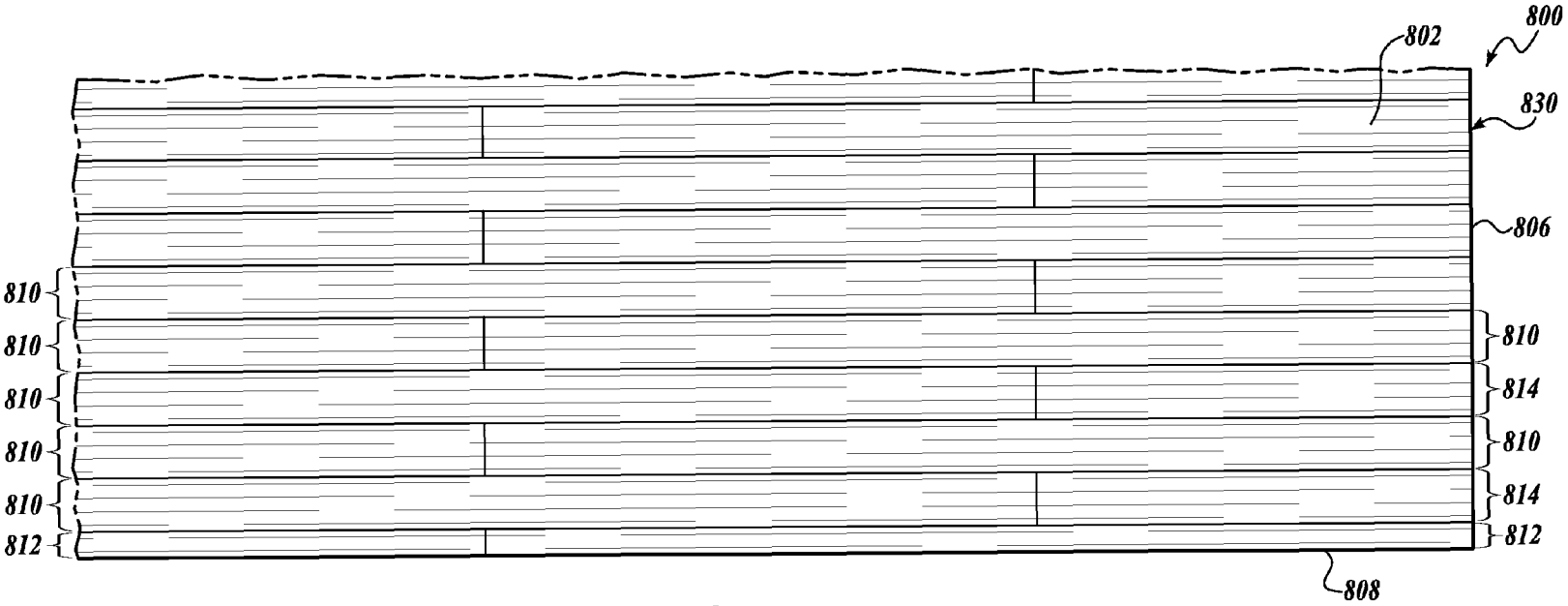
FIG. 33 is a top plan view of another archetypical block, showing a staggered assembly.

Referring now to FIG. 33, the staggered assembly briefly described above is shown as applied to a block assembly 800, generally including a strip assembly 830 with strip portions 810, ripped portions 812, strip filler portions 814, a front face 806, a side face 808, and a top surface 802. The block assembly 800 is illustrated as an example of a product longer in the direction along the side face 808 than the length of plywood sheet available for a specific grade. To create a product of this length, it is suitable to stagger the strip portions 810 during assembly of the strip assembly 830. In this regard, each strip portion 810 is suitably offset with respect to the next strip portion 810 in the direction of the side face 808.

To lengthen the block assembly 800, additional strip portions 810 are used in an abutting arrangement as shown. Finally, to create the finished edge of the front face 806, strip filler portions 814 are assembled as shown. In woodworking, this process is referred to as fanning or feathering. Although the illustrated embodiment depicts the abutment of each portion 810, 812, and 814 occurring coincident with the same location along the side face 808, in other embodiments, the abutment of each portion is suitably in different locations along the side face 808 or in a random location with respect to other abutments in the block assembly 800. In some embodiments, the offset of one strip portion 810 with respect to the next strip portion 810 is about 3 feet. In other embodiments, the offset is any distance between about 1 inch and 4 feet. In other embodiments, the strip portions 810 are assembled at various angles from the other strip portions 810 in order to integrate features into the block assembly 800 (e.g., table legs, posts, stands, dividers, partitions, sides, etc.).

While illustrative embodiments have been illustrated and described, it will be appreciated that various changes can be made therein without departing from the spirit and scope of the invention.

The embodiments of the invention in which an exclusive property or privilege is claimed are defined as follows:

1. A table top having an outer edge, comprising:

a first elongate portion of a structural laminate having a top layer, a bottom layer, an intermediate layer, and a thickness;

a second elongate portion of the structural laminate having a top layer, a bottom layer, an intermediate layer, and a thickness, the bottom layer of the second elongate portion being fixedly coupled to the top layer of the first elongate portion, the second elongate portion being divided to produce a planar cut along a major dimension and parallel to the top layer of the second elongate portion at an intermediate position of the thickness of the second elongate portion such that at least the entire top layer of the second elongate portion is removed by the cut thereby forming the outer edge of the table top, the intermediate layer of the second elongate portion being visible on the outer edge of the table top; and a substrate fixedly coupled to end surfaces of the top, bottom, and intermediate layers of the first elongate portion and to end surfaces of the bottom and intermediate layers of the second elongate portion, the substrate being positioned adjacent to the layers of the first and second elongate portions without extending beyond the outer edge of the table top.

2. The table top of claim 1, further comprising a cavity in a lower surface of the table top, wherein the substrate is recessed in the cavity such that the substrate is not visible in a side view of the table top.

3. The table top of claim 1, further comprising an elongate member fixedly coupled to a bottom surface of the table top, wherein the elongate member is positioned orthogonal to the table top so that the table top is substantially parallel to a floor.

4. The table top of claim 1, further comprising a third elongate portion of the structural laminate having a top layer and an end, wherein the first elongate portion and the second elongate portion are fixedly coupled in a staggered orientation, wherein the top layer of the third elongate portion is fixedly coupled to the bottom layer of the second elongate portion, and wherein the end of the third elongate portion abuts an end of the first elongate portion.

5. The table top of claim 1, wherein the first elongate portion and the second elongate portion include wood grains, wherein the orientation of the first portion with respect to the second portion during coupling are controlled such that the wood grains form a pattern.

6. The table top of claim 5, wherein the pattern is one of repeating, mirrored, or herringbone.

7. The table top of claim 1, wherein the thickness of the substrate is between 1/16 of an inch and 1 inch.

8. The table top of claim 1, wherein the structural laminate is plywood.

9. The table top of claim 1, wherein a surface of the table top is divided to produce a cut to expose internal wood features of at least one of the first and second portions.

10. A method for manufacturing a block having an outer edge, the method comprising:

obtaining a first portion and a second portion of a structural laminate, each portion having a top layer, a bottom layer, an intermediate layer, and a thickness;

abutting the bottom layer of the first portion of the structural laminate to the top layer of the second portion of the structural laminate;

fixedly coupling the first portion of the structural laminate to the second portion of the structural laminate;

cutting planarly the first portion of the structural laminate at an intermediate position along the thickness of the first portion of the structural laminate such that at least one entire intermediate layer of the first portion of the structural laminate is revealed thereby forming the outer edge of the block; and fixedly coupling a substrate to end surfaces of the bottom and intermediate layers of the first portion of the structural laminate and to end surfaces of the top, bottom, and intermediate layers of the second portion of the structural laminate such that the substrate does not extend beyond the outer surface of the block.

11. The method of claim 10, further comprising shaping at least one surface of the block to create a planar surface.

12. The method of claim 10, further comprising cutting of a surface of the block to expose internal wood features of at least one of the first and second portions.

13. The method of claim 10, further comprising:

obtaining a third elongate portion of the structural laminate having a top layer and an end, wherein the first elongate portion and the second elongate portion are fixedly coupled in a staggered orientation;

fixedly coupling the top layer of the third elongate portion to the bottom layer of the second elongate portion; and fixedly coupling the end of the third elongate portion in an abutting relationship to an end of the first elongate portion.

14. The method of claim 10, wherein the thickness of the substrate is between 1/16 of an inch and 1 inch thick.

15. The method of claim 10, wherein the substrate is selected from the group consisting of a layer, a bar, a strap, and a dowel.

16. The method of claim 10, wherein the material of the first and second portions is plywood.

* * * * *